United States Patent [19]

Putzke

[11] 4,297,930

[45] Nov. 3, 1981

[54] STRIP CUTTER HAVING ROTATABLE CUTTING BLADE AND STRIP DEFLECTING MEANS

[75] Inventor: Dwayne H. Putzke, Issaquah, Wash.

[73] Assignee: CX Corporation, Seattle, Wash.

[21] Appl. No.: 72,426

[22] Filed: Sep. 4, 1979

[51] Int. Cl.[3] ..... B26D 5/20

[52] U.S. Cl. ..... 83/156; 83/102; 83/111; 83/205; 83/365; 83/370; 83/443

[58] Field of Search ..... 83/42, 81, 82, 102, 83/111, 150, 154, 156, 203, 204, 205, 355, 365, 370, 373, 443, 225, 226, 229, 230

[56] References Cited

U.S. PATENT DOCUMENTS

| | | | |
|---|---|---|---|
| 2,049,515 | 8/1936 | Potdevin | 83/150 |
| 2,644,645 | 7/1953 | Bevevino | 83/354 X |
| 3,173,346 | 3/1965 | Zernov et al. | 83/156 X |
| 3,183,751 | 5/1965 | Trevaskis | 83/156 |
| 3,763,728 | 10/1973 | Blackman | 83/365 X |
| 3,925,786 | 12/1975 | Haas | 83/205 X |
| 3,967,518 | 7/1976 | Edwards | 83/365 X |
| 3,977,280 | 8/1976 | Mundt et al. | 83/578 X |
| 4,013,357 | 3/1977 | Nakajima et al. | 83/111 X |
| 4,046,470 | 9/1977 | Yamamoto | 83/205 X |

*Primary Examiner*—Frank T. Yost
*Assistant Examiner*—Robert P. Olszewski
*Attorney, Agent, or Firm*—Christensen, O'Connor, Johnson & Kindness

[57] ABSTRACT

A photographic processing apparatus for severing an advancing strip into successive segments and for mechanically segregating the segments in conjunction therewith includes a strip feed for advancing the strip in a lengthwise direction and a guide for guiding the strip past a cutting station in a predetermined path of advance. A cutting blade is mounted at the cutting station and is operable to sever from the strip the segments thereof that have passed the cutting station. The blade has a home position wherein it permits passage of the strip along the path of advance before severance and is movable through a cutting stroke from the home position and back into the home position. The blade has a deflecting position wherein it permits passage of the strip beyond the cutting station while deflecting the strip from the path of advance. A blade actuator is provided to move the blade into and from the home position and deflecting position and through the cutting stroke in timed relation to strip advancement.

4 Claims, 13 Drawing Figures

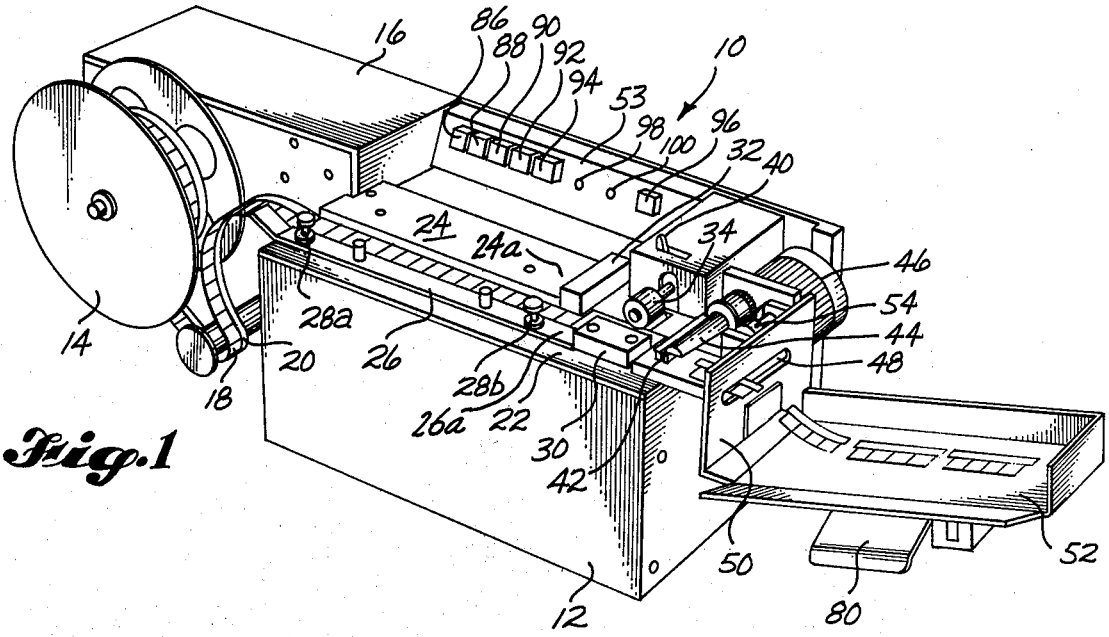
Fig. 1
Fig. 3
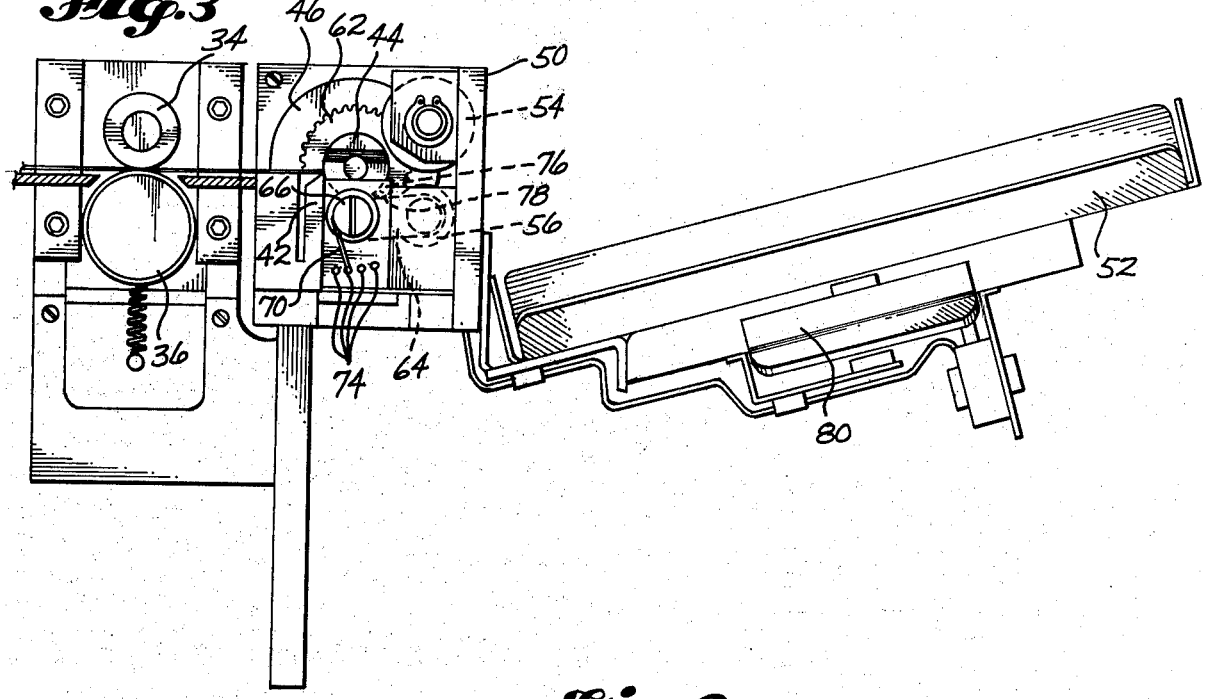
Fig. 2
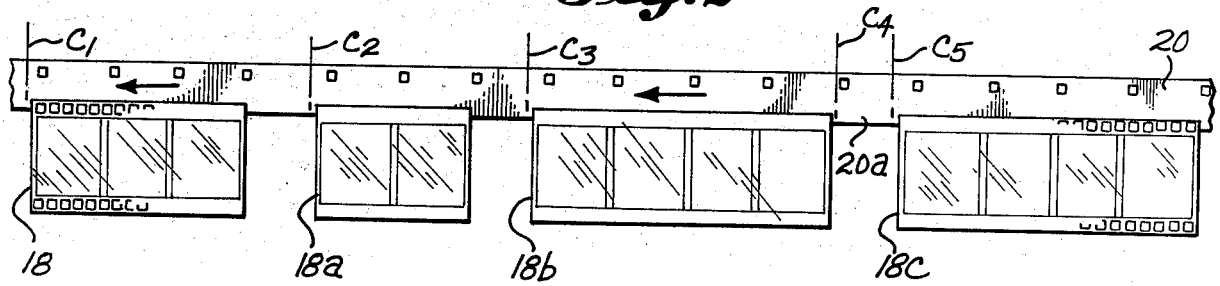

STRIP CUTTER HAVING ROTATABLE CUTTING BLADE AND STRIP DEFLECTING MEANS

BACKGROUND OF THE INVENTION

This invention relates to photographic film processing equipment and more particularly relates to a strip cutter having a multiposition rotatable cutting blade which can also act as a strip segment deflector. The invention is herein illustratively described in its preferred form and application; however, it will be recognized that modifications and variations therein may be made without departing from the essential features involved.

In the photographic film processing industry, the exposed and developed film negatives that are returned to the customer after a roll of film is processed are generally in the form of multi-frame strips of film up to four frames in length. If the customer desires to have additional photographs printed from the negatives, the customer returns the negative strip or strips containing the desired frames to be printed to the photofinisher. In order to be able to batch process a number of these film negative strips in a continuous operation, the strips are adhesively bonded by one longitudinal margin in endwise serial positions on a continuous tabbing strip for winding the same on a storage reel permitting the film strips to be run through the printing apparatus.

After the selected frame photographs have been printed, and before returning the negative strips to the customer it is necessary to separate the individual strips and place them in customer delivery envelopes. The simplest and most efficient method yet found for separating the negative strips is imply to sever the tabbing material between adjacent negative strips for return to the customers with the tabbing material still attached.

For reasons of economic practicality the customer delivery envelopes referred to are of standard size and are of a length just sufficient to accommodate strip lengths up to and including that of four-frame 35 mm. strips (i.e. the standard maximum length of negative film submitted for printing). However, when the film strips are originally bonded to the tabbing strip gaps are left between the ends of the successive film strips. Therefore, when a four-frame segmental length of the tabbing strip is severed at the ends of the associated film strip so as to fit the customer envelope, a byproduct requiring separate disposal is produced in the form of the short connecting tabbing strip segment or chip that spanned the gap to the next film strip segment mounted on the tabbing strip. The present invention is illustratively described in its application to severing the tabbing strip at the required locations and in conjunction therewith segregating the byproduct tabbing strip gap lengths for separate disposal.

Machines have been produced for the automatic cutting of the tabbing material strips; however, in prior machines both the negatives and the unwanted tabbing material chips have been dilivered by the cutting machine to a common receptacle and it has been left for an operator to manually sort the usable and returnable negative strips from the unwanted tabbing material chips prior to placing the negative strips in the envelope for return to the customer. The photofinishing industry operates on very high production volumes of film processed each day, and it is desirable to automate the film handling as much as possible both to cut labor costs and to shorten processing tim. It is therefore an object of this invention to provide a strip cutter that automatically feeds and cuts the film-bearing tabbing strip into film-bearing segments and that selectively and mechanically segregates from the film-bearing segments the short lengths or chips of tabbing strip material occurring between adjacent strips of film.

It is a further object of this invention to provide a strip cutter that can automatically cut out and separately dispose of short lengths of tabbing material from between adjacent film strips or segments.

It is another object of this invention to provide a relatively simple and reliable mechanism achieving these purposes with a minimum number of parts utilizing the cutting blade itself as a means of separating the severed tabbing chips from the film strips.

It is another object of this invention to provide such a strip cutter and deflector mechanism capable of performing its functions rapidly and with minimum interruption in the ongoing advancement of the composite strip being severed.

SUMMARY OF THE INVENTION

In accordance with the foregoing objects, the present invention provides an apparatus for severing and segregating successive segments of an advancing strip such as a tabbing strip bearing segmented lengths of negative film. The apparatus includes means to advance and guide the composite strip to an operating station along a predetermined path after it leaves the roll. At the operating station a cutter blade is operated in response to a signal means sensing strip position so as to sever the tabbing strip at the leading edge of each film segment, and, in instances of 35 mm. film segments four frames in length, also at the lagging edges of those segments, in which instances tabbing strip chips are produced. In those latter instances after the lagging edge cut is made the blade, instead of returning directly to its normal home position, moves into an interim inclined chip deflector position, thereby to direct the waste chip out of the regular film discharge for disposal as waste.

In the preferred embodiment of the invention the blade means is positioned for rotational movement between its normal home position, its cutting stroke completion position and its alternate chip deflecting position. The blade means is preferably driven by a stepper motor under control of a film indexing means sensing the advancing positions of the leading and lagging edges of the successive film strip segments so as to stop the film and operate the cutter in timed relation with arrival of a cutting point on the strip and, in instances of waste length chips to be cut from the tabbing strip, the shift the cutter into chip deflecting position preparatory to the succeeding cut following resumption of film advancement after the last previous cut is made.

BRIEF DESCRIPTION OF THE DRAWINGS

The above and other features, objects, and advantages of the present invention will be better understood by those of ordinary skill in the art upon reading the ensuing specification in conjunction with the attached drawings wherein:

FIG. 1 is an isometric view of a cutter apparatus embodying the present invention.

FIG. 2 is a view of a length of typical tabbing strip material with multi-frame length segments of negative film marginally bonded to it for serial processing and storage.

FIG. 3 is a front elevational view of the cutting portion of the strip cutter of FIG. 1 with parts removed or shown in section.

In FIG. 7A the intervening chip of tabbing strip is shown positioned beneath the cutting and deflecting mechanism. In FIG. 7B the cutting and deflecting mechanism is shown in the deflecting position engaging the tabbing strip. FIG. 7D shows the next segment of negative film being fed through the cutter with the cutting and deflecting mechanism in the normal, home position. FIG. 7E shows the tabbing strip being severed following the negative film segment of FIG. 7D. Finally, FIG. 7F shows the separated segment of negative film being ejected from the strip cutter.

DETAILED DESCRIPTION OF THE PREFERRED EMBODIMENT

Figure 4:
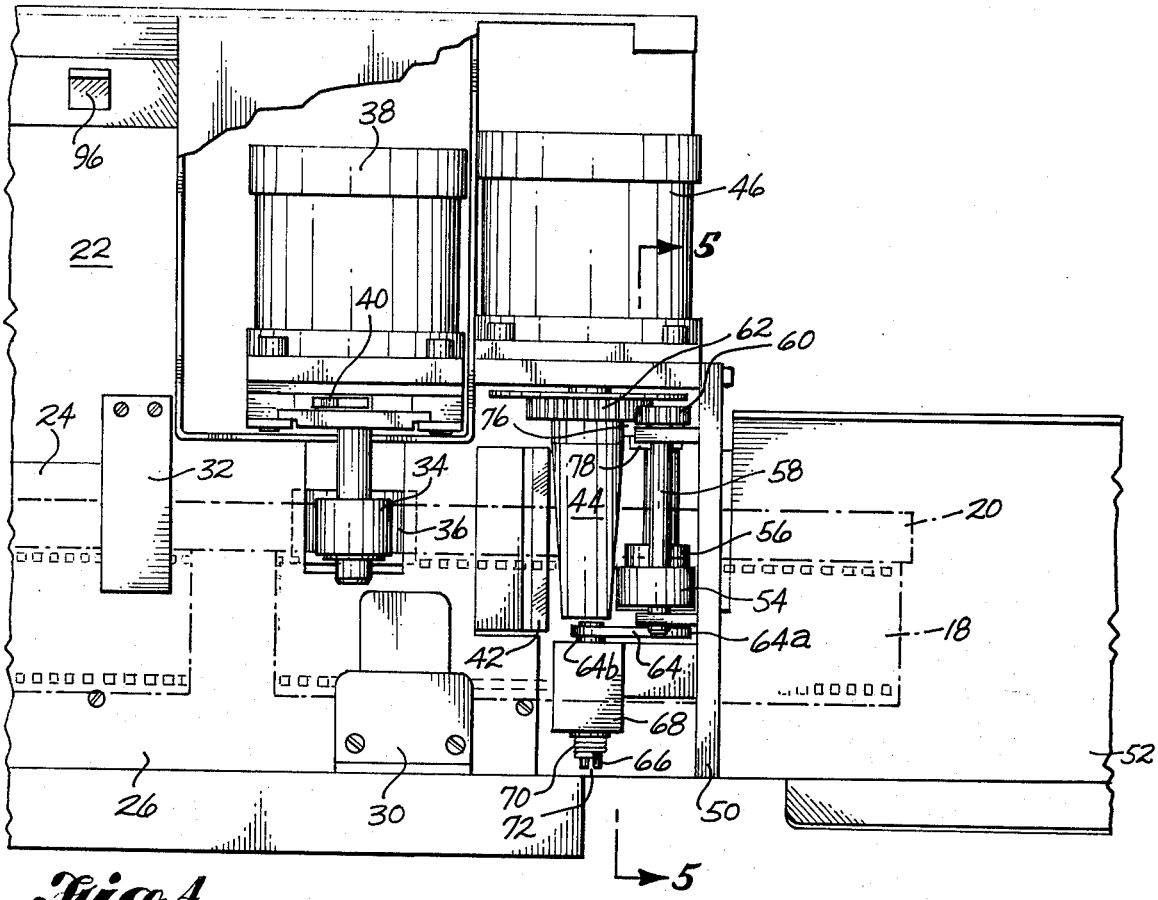
FIG. 4 is a plan view of the cutting and segregating portion of the strip cutter of FIG. 1.
Figure 5:
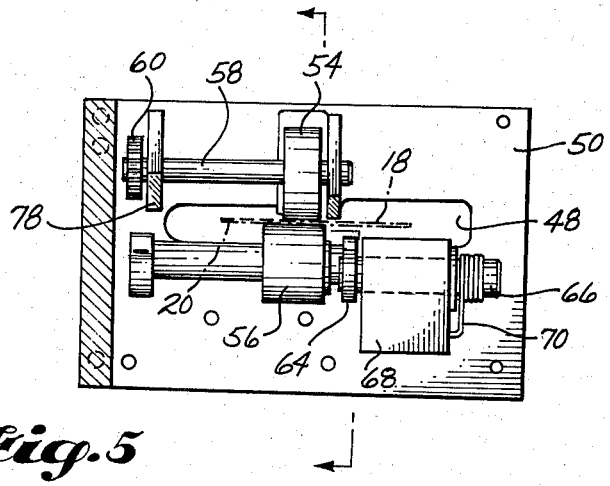
FIG. 5 is a sectional view of the strip cutter taken along line 5—5 of FIG. 4.

While the present invention is herein described and illustrated in the photofinishing environment and specifically disclosed as a cutter for separating segments of negative film from a continuous tabbing material strip it will be clear to those of ordinary skill that the strip cutter of the present invention can be used in any situation in which a continuous strip of material is to be severed into individual segments and certain ones of the segments are to be segregated from the other segments.

FIG. 1 illustrates one embodiment of a strip cutter made in accordance with the principles of the present invention. The strip cutter 10 includes a main cabinet 12 that houses the electronics for control and operation of the cutter and on which the other parts of the cutter mount. A spool 14 is rotatably mounted on a film supply cabinet 16 affixed to the left side of the main cabinet 12 as viewed in FIG. 1. Segments of developed negative film 18 are attached to a continuous strip of tabbing material 20 to form a composite strip as best seen in FIG. 2. When processing 126 or 110 size film the negative segments are of uniform length, however FIG. 2 illustrates the case of 35 mm. film wherein the individual segments of negative film can vary in length. The continuous strip of tabbing material with attached negative segments is wound onto the spool 14. From the spool 14 the composite strip is fed across the top plate 22 of the main cabinet 12. The path of the strip across the top plate 22 is determined by a rear film guide 24 affixed to the top plate of the strip cutter housing. The position of the film guide 24 is determined by the width of the tabbing material which is being used which in turn depends upon the manufacturer of the printing equipment being used. The tabbing material passes beneath the rear film guide 24 as it moves across the top plate 22 of the main cabinet 12. A front film guide 26 is attached to the top plate 22 spaced from the rear film guide so that the unattached edges of the negative segments pass beneath the front film guide 26 as the composite strip passes across the top plate 22. The front film 26 is secured to the top plate 22 by two finger release plungers, **28*a* and 28*b* respectively. The front film guide 26** can be moved to two different positions in order to change the spacing between the front and rear film guides to accommodate 126/135 size film and 110 size film.

A film sensor 30 is mounted on the first end **26*a* (right hand end as viewed in FIG. 1) of the front film guide 26 positioned over the path of the negative segments. An end-of-order sensor 32 is mounted on the first end 24*a* (right end as viewed in FIG. 1) of the rear film guide 24 positioned so as to overlie the tabbing material. The end-of-order sensor 32 detects the end-of-order marker or "twin check" affixed to the tabbing material between each customer order. The film sensor 30 and end-of-order sensor 32** will be described in greater detail below.

The composite strip is pulled from the spool 14 by a pair of rollers that are positioned adjacent the first end **26*a* of the front film guide. The strip of tabbing material is gripped by the nip formed by a pressure roller 34 which is spring-loaded to press downwardly against the a lower drive roller 36 in order to ensure good frictional contact between the pair of rollers and the tabbing strip. The drive roller 36 is directly coupled to a stepper motor 38 which is driven in response to signals from the film sensor 30 processed through a logic circuit to advance the composite strip to the proper position for cutting of the tabbing material. The drive roller 36 is preferably a urethane coated roller. A lever cam 40 is provided in conjunction with the pressure roller 34 for manual operation to lift and hold the pressure roller 34 from the drive roller 36** for ease of strip threading at the time the strip is first loaded into the cutter.

The rollers 34 and 36 feed the strip over an anvil 42. A rotary knife 44 driven by a second stepper motor 46 is located above the anvil 42 (to the right of the drive rollers as viewed in FIG. 1.) The knife 44 is capable of clockwise and counterclockwise rotation about an axis transverse to and offset from the path of the composite strip with the cutting edge of the knife 44 being transverse to the direction of strip movement. The tabbing strip is cut between the knife 44 and the anvil 42 and the separated segments of negative film exit the cutter 10 through a slot 48 formed in an end wall 50 of the cutter 10 and fall into a tray 52 positioned below the slot and affixed to the end of the cutter from which they can be removed by an operator and packaged for return to the customer.

A control panel 53 is mounted on the rearward portion of the top plate 22 of the cutter main cabinet 12 and contains the controls by which the operator selects the mode of operation of the cutter and also indicator lights to indicate the operational status of the cutter. The control panel will be described in greater detail below.

Referring now to FIG. 3 the film drive and knife support sections of the film cutter are shown with portions of the film cutter housing removed to better show the details of the knife assembly. In normal operation the pressure roller 34 and drive roller 36 are in close proximity to one another to grip the tabbing material and pull it from the spool 14 and to force it towards the knife 44. The cutting knife 44 is substantially in the shape of half a truncated cone split longitudinally. As seen in FIG. 3 the knife is semicircular in cross section said cross section diverging from a small semicircle at the forward end of the cutter to a larger diameter semicircle at the rearward edge of the cutter. The knife is mounted so that the cutting edge of the knife is transverse to the direction of film movement. The knife 44 is mounted on a shaft directly coupled to the second stepper motor 46 and is driven by the stepper motor in response to the logic circuitry which will be described in greater detail below. The knife is arranged so that in its normal or home position the flat of the blade is parallel to the composite strip so that the strip can pass beneath the knife unimpeded. The stepper motor rotates the knife counterclockwise (as viewed in FIG. 3) and the tabbing material is cut between the anvil 42 and the cutting edge of the knife as the cutting edge rotates downwardly past the upper edge of the anvil. The cutting edge of the blade does not actually touch the anvil, the tolerances being such that the blade passes within a few thousandths of an inch of the anvil to cut the film in a pinching type action.

After the strip is cut, the separated segment of negative film is assisted in its exit from the cutter by upper and lower ejector rollers, 54 and 56 respectively. The upper ejector roller 54 is mounted for rotational movement on a shaft 58 affixed to a follower gear 60. The follower gear 60 engages a drive gear 62 affixed coaxially with the knife blade 44 to the second stepper motor shaft. The drive gear 62 drives the follower gear 60 as the knife blade 44 rotates. The upper ejector roller 54 is one-way clutched so that it only turns when the knife is rotating in a clockwise direction. The upper ejector roller therefore turns when the knife blade moves from the cutting position to the home position but does not turn when the knife blade moves from the home position to the cutting position.

Figure 6:
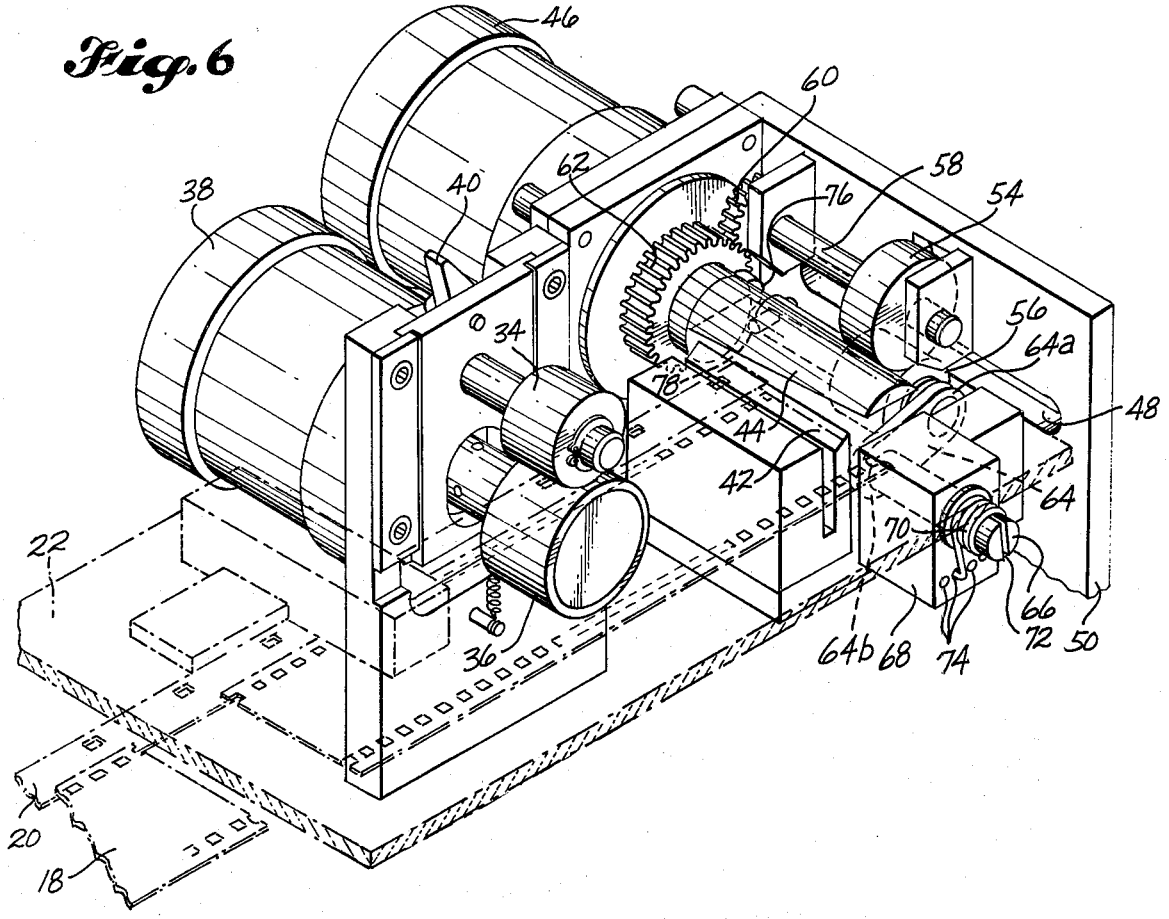
FIG. 6 is an enlarged isometric view of the strip cutter of FIG. 1 with portions removed.

As can best be seen in FIGS. 3 and 6, the lower ejector roller 56 is mounted for rotational movement on a first end 64*a* of a crank arm 64. The second end 64*b* of the crank arm 64 is affixed to a pin 66 which is journaled in a bearing block 68 affixed to the chassis of the cutter. The crank arm 64 is free to pivot about the pin 66 so that the lower ejector roller 56 can move into and out of contact with the upper ejector roller 54. The lower roller 56 is biased into contact with the upper roller by a coil spring 70 coiled about the pin 66. One tang of the spring 70 engages a slot 72 in the end of the pin 66 and the other tang of the spring 70 engages one of a series of tension adjustment holes 74. The biasing force on the roller 56 can be selectively varied by moving the tang of spring 68 to various one of the tension adjustment holes. The lower ejector roller 56 is moved into and out of contact with the upper ejector roller 54 by means of a cam 76 on the knife 44 and a cam follower 78 affixed to the crank arm. The details of the cam arrangement are described below.

FIG. 4 is a plan view of the film drive and knife assemblies of the negative cutter and shows clearly the spatial relationships of the various parts of the cutter. The film drive roller 36 and pressure roller 34 engage only the tabbing material strip and not the segments of negative film thereby preventing any scratching or other damage to the negative film so that it can be used to print photographs in the future. The upper and lower ejector rollers are positioned to engage the segment of negative film itself. The end-of-order sensor 32 is mounted so that it overlies the tabbing material. The twin check signifying an end of an order is mounted directly on the tabbing material. The film sensor is offset from the end-of-order sensor transversely to the direction of film movement so that it lies above the path of the film to sense the presence or absence of film and communicate that information to the logic control circuit to control movement of the film through the cutter as will be explained below.

Referring to FIG. 2, when the cutter is handling a composite strip composed of negative film segments 18, 18*a*, 18*b*, and 18*c* of varying frame number and consequently varying length, the longer film segments, i.e., those four frames long, will be too long to fit in an envelope if the tabbing material is cut adjacent only the leading edge of each negative segment thereby leaving the tabbing material extending past the trailing edge of the segment. It is therefore necessary to selectively remove the tabbing piece 20*a* between the trailing edge of a four frame segment 18*b* and the leading edge of the next segment 18*c*. FIGS. 7A through 7F illustrate a complete sequence of a mode of operation of the cutter designed to remove the tabbing material chip 20*a*.

The tabbing material 20 is cut adjacent the leading edge of each segment of negative film as shown by lines $C_1$, $C_2$, $C_3$, and $C_5$. The negative segment is then advanced beneath the knife blade between the ejector rollers which are at that time spaced from one another and through the slot in the end wall 50 of the cutter housing into the film catcher tray. The composite strip is normally advanced until the leading edge of the next negative segment is positioned on the anvil for cutting of the tabbing material. However, if the film sensor does not signal the film drive logic circuits of the trailing edge of the advancing negative segment within a predetermined distance (5.25 inches in the standard 35 mm. case) the composite strip is advanced only to the trailing edge of the negative segment and the tabbing material is cut adjacent the trailing edge, as shown by line $C_4$, so that the individual negative segment and attached tabbing material emerging from the cutter are no longer than a predetermined distance (determined by envelope length and approximately 6.25 inches in the standard 35 mm. case). After the trailing edge cut is made the knife returns to the home position and the separated negative segment is ejected into the film catcher tray by means of the gear and clutch arrangement associated with the knife 44 and the upper ejector roller 54.

Figure 7E:
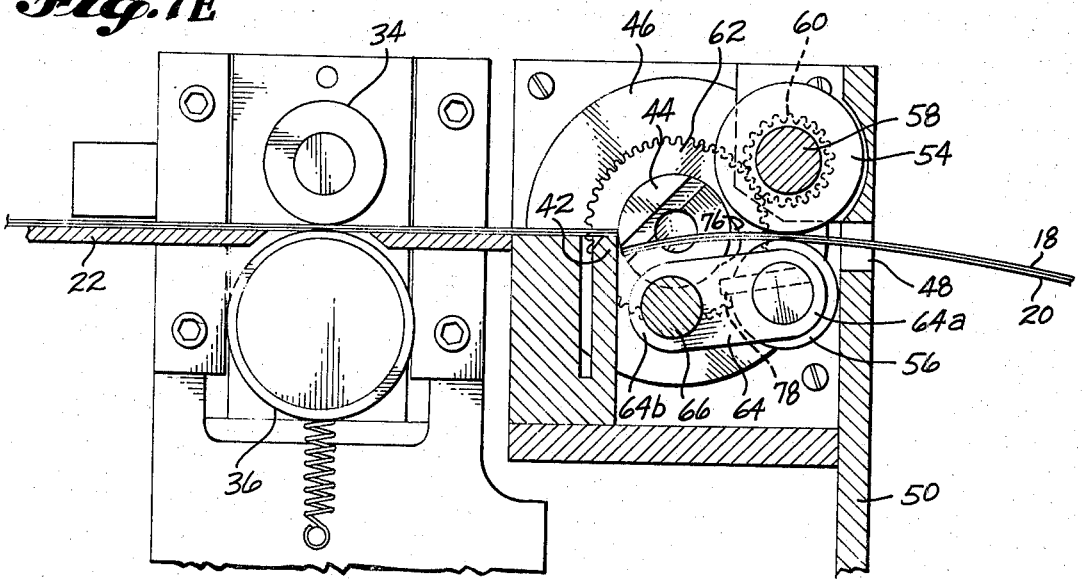
FIGS. 7A–F are partially sectional side elevational views of the cutting portion of the strip cutter of FIG. 1 showing the sequence of operation of the cutter.
Figure 7A:
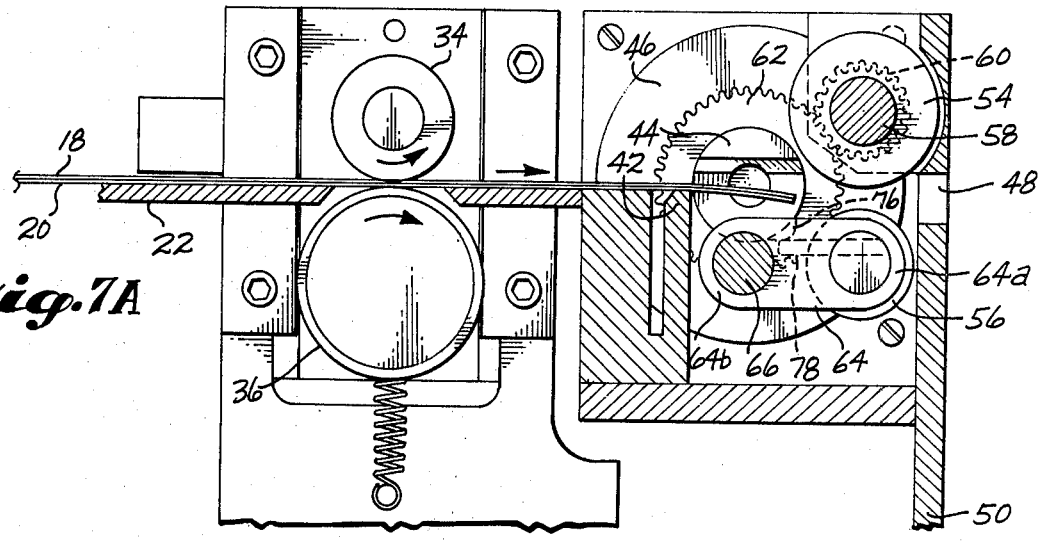

Since the cutter always makes a cut at the leading edge of each negative segment there will be an unattached chip of tabbing produced, i.e., tabbing material piece 20*a* bridging the gap between the trailing edge of the separated negative segment and the leading edge of the following negative segment. The next sequence of operation of the cutter is designed to segregate that unattached chip of tabbing 20*a* from the negative segments entering the film tray. FIG. 7A shows the first step in the segregating sequence. The composite strip is advanced a predetermined distance (0.7 inches in the case of 35 mm. film) to place the leading end of the unwanted tabbing material chip beneath the knife 44. The knife is then rotated in a clockwise direction (as viewed in FIGS. 7A–F) 45° thereby deflecting the leading end of the tabbing material downwardly adjacent the outer edge of the lower ejector roller 56. The composite strip is then advanced a distance sufficient to position the leading edge of the next negative segment in position on the anvil 42.

Figure 7B:
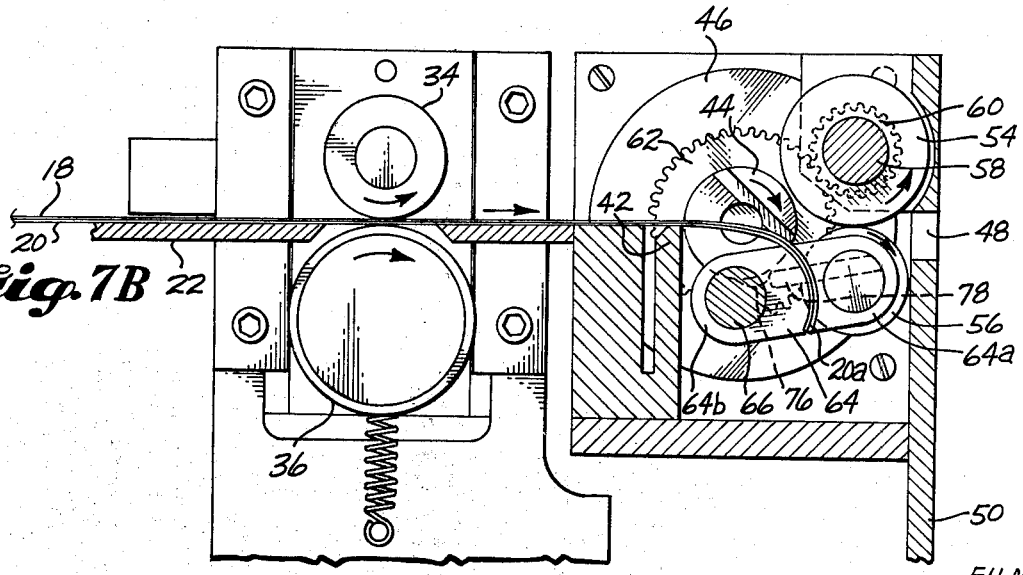
Figure 7C:
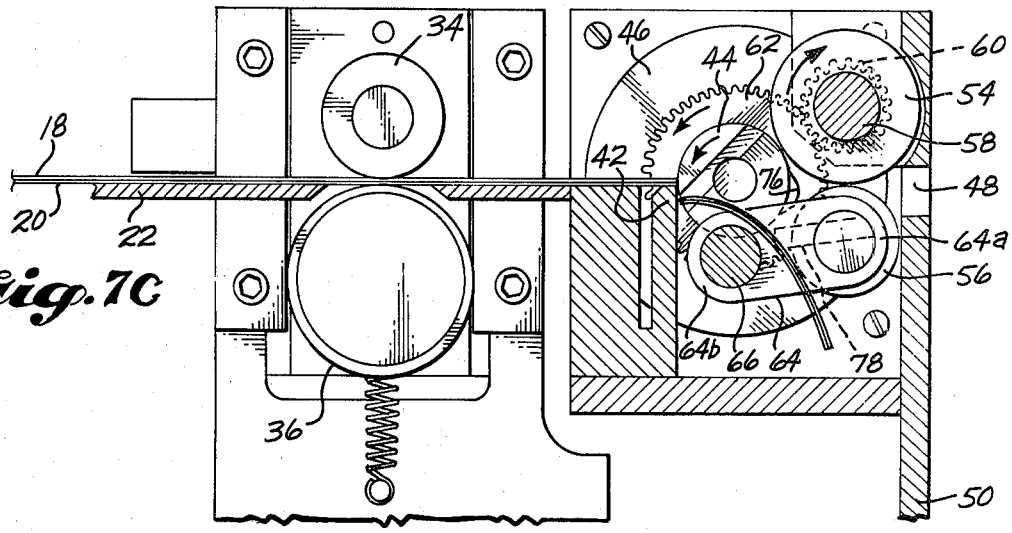

Referring to FIG. 7*b* after advancement of the strip to the next leading edge the tabbing material is curved downwardly being reflected by the clockwise rotation of the knife. When the leading edge of the next negative segment is in position on the anvil the knife is rotated counterclockwise (as viewed in FIGS. 7A–F) 90° to a position 45° counterclockwise of the home position thereby severing the tabbing material, as best seen in FIG. 7C. The downwardly bent tabbing material chip is at that time separated from the composite strip and is allowed to fall through the bottom of the cutter housing into a waste receptacle (not shown).

Figure 7D:
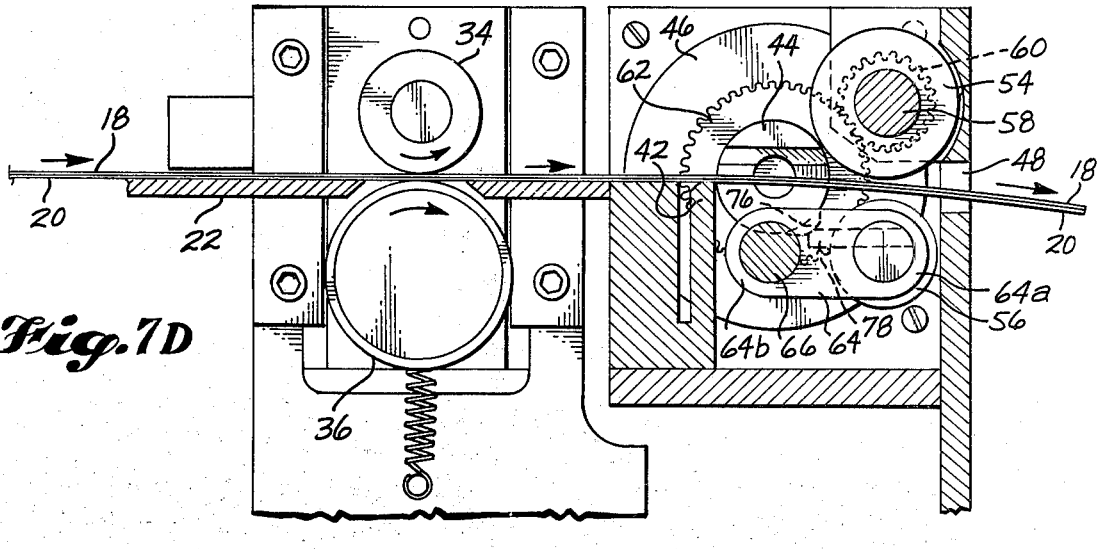
Figure 7F:
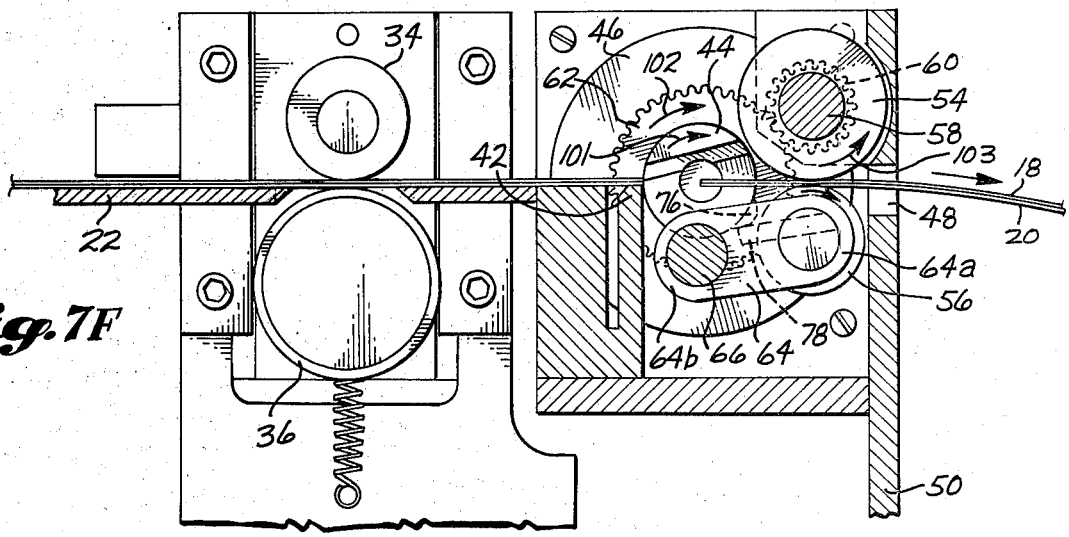

Referring now to FIG. 7D, once the unwanted chip of tabbing material has been cut away, the knife is driven back to the home position by the stepper motor and the composite strip is advanced either until the leading edge of the next negative segment or in case a trailing edge is not severed within the predetermined distance until the next trailing edge in which case the sequence of operation discussed above is repeated and for a predetermined distance as described above. At that time the film is in position on the anvil for a trailing edge cut. Whatever the case the knife is rotated 45° counterclockwise to cut the tabbing material and thereby separate the negative segment from the composite strip as shown in FIG. 7E. In FIG. 7F the knife is shown returning from the cutting position to the home position and the separated negative segment is shown being ejected from the cutter through the slot 48 in the end wall 50 of the cutter housing. the arrows 101, 102, and 103 show the direction of rotation of the knife 44, drive gear 62 and ejector roller 54 as they assist the negative segment in its exit from the cutter.

It is clear from a description of one complete cutting sequence that the lower ejector roller 56 moves into and out of engagement with the upper roller 54 as the sequence progresses. At the time that the knife 44 is in the cutting position the cam 76 affixed to the knife 44 is disengaged from the bullet-nosed cam follower 78 attached to the ejector roller shaft and the lower ejector roller is forced toward the upper ejector roller by coil spring 70. As the knife 44 returns to its home position the cam 76 engages the bullet-nosed cam follower 78 forcing the lower ejector roller 56 and crank arm 64 downwardly overcoming the tension of the spring 70 and causing the upper and lower ejector rollers to be spaced from one another to allow passage of the film between them.

The cutting sequence described above and illustrated in FIGS. 7A–F is repeated until the end-of-order sensor 32 senses an end-of-order marker or "twin check" on the tabbing material signifying the end of a single order. At that time the cutter stops to allow the operator to remove the separated negative segments from the tray 52 to either be placed in envelopes or to be passed on a sorting machine for further processing. A lever 80 is mounted on the film catcher tray and is coupled to a micro-switch 81. As the operator removes the negative strips from the catcher, the operator can easily hit the lever, thereby closing the micro-switch 81 sending a start signal to the control logic to start a new cutting sequence for the next order.

In another mode of operation the tabbing material is cut only at the leading edge of each negative segment. This mode of operation does not remove the intermediate chips of tabbing between adjacent negative segments and therefore it is not necessary to provide any deflection of the tabbing material between adjacent negative segments for segregation into a separate receptacle. This second mode of operation is used when the negative segments and the spacing between successive negative strips is uniform and does not exceed the length of the film envelopes, for example, in the case of 126 or 110 film.

Figure 8:
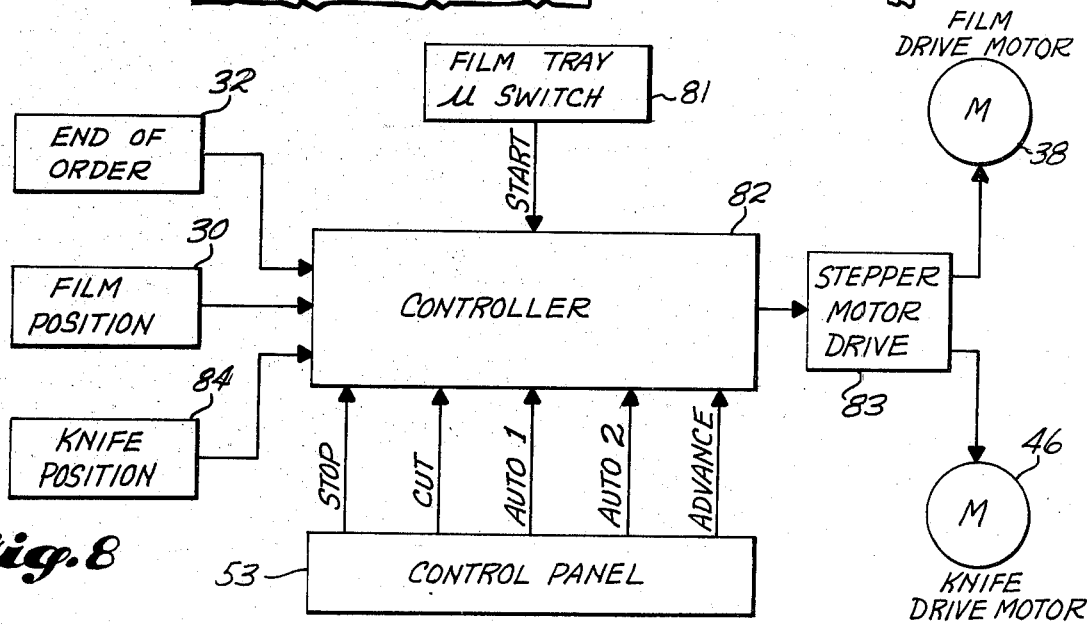
FIG. 8 is a functional block diagram of the signal flow associated with the film cutter of FIG. 1.

The logic functions required to operate a cutter made in accordance with the pinciples of the present invention are shown in FIG. 8. The end-of-order sensor 32 can be any one of several conventional sensing devices, for example, the end-of-order sensor could consist of an infrared light-emitting diode (LED) and a phototransistor mounted on interconnected, separate assemblies and above the film track. The infrared light from the LED is passed through the tabbing material and is received by the phototransistor. The "twin check" label which is fastened to the tabbing material to mark the end of an order is composed of an infrared dense material so that when the "twin check" passes over the infrared LED most of the infrared light is absorbed by the "twin check." The phototransistor senses the change in infrared light level thereby changing the output level of the phototransistor. This change in output level is fed to the motion controller 82 to signal that the end of an order has been reached and generating a stop signal to stop the operation of the cutter.

The controller 82 also receives signal which relate to the position of the negative segments. The film sensor 30 is mounted on the front film guide 26 overlying the path of the negative segments through the cutter and can consist of any conventional sensing means, for example, a green LED and phototransistor, mounted on interconnected, separate assemblies below and above respectively the negative path. The sensor is adjusted to indicate presence or absence of film over the LED by virtue of the phototransistor sensing the change in light levels between the presence and absence of the film caused by the opacity of the film. The output of the phototransistor is therefore a voltage which changes depending upon the presence or absence of film between the LED and the phototransistor. A voltage change occurs therefore at each leading and trailing edge of the negative segments. The position information is processed by the controller and in response to the position information the controller causes the stepper motor 38 to either stop or advance the strip drive through the cutter.

A third input signal is provided to the controller 82 from a knife position sensor 84 that provides information as to the position of the knife in order to provide a starting point for running the stepper motor 46 to rotate the knife between its deflecting and cutting positions. The knife position sensor 84 also may consist of any conventional position sensing means, for example, an apertured disc can be mounted on the knife and an opposed LED and phototransistor pair can be mounted on the assembly in such a way that when the knife is in home position the aperture in the disc is in the light path from the LED to the phototransistor allowing light to be transmitted from the LED to the phototransistor. When the knife is not in the home position, the aperture will not line up with the LED and phototransistor and the light path will be blocked. A voltage change will then appear at the output of the phototransistor. The voltage change indicates to the controller 82 whether the knife is at home position. Prior to initiating any sequence of the cutter the controller checks to see if the knife is in the home position based on the voltage output from the phototransistor. If the knife is not in the home position, the stepper motor drives the knife until the aperture is in line with the LED and phototransistor pair. In the preferred embodiment the knife is driven in a counterclockwise direction during initialization; however, with suitable modification to the logic circuitry the knife drive could be in either a clockwise or counterclockwise direction. Once the knife is in home position the cutting sequence can then begin with the controller having a known starting point from which to drive the knife. After each order is processed, the cutter stops its automatic operation and waits for a start signal from the lever-actuated micro-switch on the film tray to the controller to begin a new cycle of operation.

The controller 82 can consist of any suitable logic circuitry that performs the necessary logic function. The circuit could comprise a series of discrete components in standard AND/OR gate logic along with suitable counters to determine the number of steps which the motors must take to position the film and the knife properly. Alternatively, the controller logic is well suited for the application of a micro processor which can be combined with a random access memory (RAM) to store and receive raw data, for example, the signals from the position sensors, and a programable read-only memory (PROM) in which the operating program for the micro processor can be stored.

The controller 82 also receives signals from the control panel 53. The control panel preferably contains a series of pushbutton switches which are depressed to send discrete signals to the controller to initiate certain cutter operations. An ADVANCE switch 86 is provided to advance the film by single steps of the stepper motor each time the ADVANCE switch is depressed. A second switch 88 is a CUT switch. Depression of the CUT switch activates the knife through one complete cut cycle. Depression of the STOP switch 90 stops the film advance and returns the knife to the home position. The signal from the STOP switch 90 also removes the cutter from the automatic mode of operation.

The automatic mode of the cutter is initiated by depression of the AUTO 1 switch 92 or the AUTO 2 switch 94. The AUTO 1 switch initiates the cutter mode described above for use with 126/110 size film in which a single cut is made at the leading edge of each negative segment. In this mode the intervening tabbing matterial remains attached to the negative segments. The AUTO 2 switch initiates the mode of the cutter used with 35 mm. film in which negative segment length is monitored and the intervening portions of tabbing material are removed if necessary to prevent the separated negative segments from exceeding the maximum predetermined length.

The control panel 53 preferably also contains a power ON/OFF switch 96 and two indicator lights 98 and 100. The indicator 98 lights whenever the cutter is in either automatic mode and the indicator 100 lights to indicate that the power switch is in the On position and power is applied to the cutter.

While a preferred embodiment of a negative cutter made in accordance with the principles of the present invention has been described and illustrated it will be apparent to those of ordinary skill in the art and others, that several changes and modifications can be made to the film cutter while remaining within the spirit and scope of the present invention. Further, although the invention herein has been described in the photoprocessing environment, it will be apparent to those of ordinary skill in the art that a cutter made in accordance with the principles of the present invention can be used in any situation in which it is desired to cut successive segments from a continuous strip and selectively segregate certain of those segments in a separate discharge area. The scope of the present invention is to be determined solely from the claims which follow.

The embodiments of the invention in which an exclusive property or privilege is claimed are as follows:

1. A photographic processing apparatus for severing an advancing strip into successive segmental lengths and for mechanically segregating these segmental lengths in conjunction therewith, said apparatus comprising:

strip feed means for advancing said strip in a lengthwise direction;

strip guide means for guiding the advancing strip past the cutting station in a predetermined path of advancement continuing past said cutting station;

cutter blade means mounted at said cutting station and operable to sever from the strip segmental lengths thereof that have advanced past said cutting station, said blade means having a home position wherein it permits passage of the strip along said path of advancement before severance and being movable through a cutting stroke from said home position and back into said home position, said blade means further having a strip deflecting position wherein it permits passage of the advancing strip beyond said cutting station while deflecting the strip from said path of advancement before severance;

blade actuating means operable to move the blade means into and from said home and deflecting positions and through said cutting strokes in timed relation with strip advancement positionings effected by said strip feed means; and ejector means for assisting the advancement of said segmental lengths away from said cutting station after severance, said ejector means including a first roller mounted above the path of advancement of said strip beyond said cutting station, said first roller being drivingly coupled to said blade means such that said first roller rotates in response to movement of said blade means, said first roller being clutched so that it rotates only in response to movement of said blade means from said cutting stroke toward said home position, a pressure roller rotatably mounted below the path of advancement of said strip beyond said cutting station, said first roller and said pressure roller cooperating to form a nip, said severed strip segment engaging said nip after passing said cutting station and biasing means associated with said pressure roller for biasing said pressure roller toward said first roller.

2. A photographic processing apparatus for severing an advancing strip into successive segmental lengths and for mechanically segregating the segmental lengths in conjunction therewith, said apparatus comprising:

strip feed means for advancing said strip in a lengthwise direction;

strip guide means for guiding the advancing strip paste the cutting station in a predetermined path of advancement continuing past said cutting station;

cutter blade means mounted at said cutting station and operable to sever from the strip the segmental lengths thereof that have advanced past said cutting station, said blade means having a home position wherein it permits passage of the strip along said path of advancement before severance and being movable through a cutting stroke from said home position and back into said home position, said blade means further having a strip deflecting position wherein it permits passage of the advancing strip beyond said cutting station while deflecting the strip from said path of advancement before severance;

blade actuating means operable to move the blade means into and from said home and deflecting positions and through said cutting strokes in timed relation with strip advancement positionings effected by said strip feed means; and ejector means for assisting the advancement of said segmental lengths away from said cutting station after severance, said ejector means including a first roller rotatably mounted above the path of advancement of said strip beyond said cutting station, said first roller being drivingly coupled to said blade means such that said first roller rotates in response to movement of said blade means, said first roller being clutched so that it rotates only in response to movement of said blade means from said cutting stroke toward said home position, a pressure roller rotatably mounted below the path of advancement of said strip beyond said cutting station, said first roller and said pressure roller cooperating to form a nip, said pressure roller being mouned for movement toward and away from said first roller in response to movement of said blade means from said home position toward said cutting stroke, said pressure roller being spaced from said first roller when said blade means is in said home position and said pressure roller moving toward said first roller as said blade means moves toward its cutting stroke, said severed strip segment engaging said nip after passing said cutting station and biasing means associated with said pressure roller for biasing said pressure roller toward said first roller.

3. In a strip cutter for separating adjacent negative film segments attached to a continuous strip of tabbing material by severing said tabbing material between adjacent negative segments as said continuous strip advances through said strip cutter, said strip cutter having means for selectively removing chips of tabbing material from between adjacent negative segments, said separated film segments exiting said strip cutter in a first direction, means for mechanically segregating said tabbing material chips from said separated film segments including a blade means operable to cut said tabbing material and mounted for rotational movement from a home position in which said blade means allows said separated segments to exit said strip cutter in said first direction through a cutting stroke in which said blade means engages and severs said tabbing material and back to said home position, said blade means further having a deflecting psition wherein it engages said tabbing material chip prior to severance and deflects said tabbing material chip away from said first direction and blade actuating means for moving said blade means into and from said home and deflecting positions and through said cutting stroke in timed relation to the advancement of said strip, the improvement comprising ejector means mounted adjacent said blade means for assisting the negative segments in exiting the cutter after separation of the segments, said ejector means including a first roller rotatably mounted above the path of advancement of said strip, said first roller being drivingly coupled to said blade means, said roller being clutched so that it rotates only in response to movement of said blade means from said cutting strip toward said home position, a pressure roller rotatably mounted below the path of advancement of said strip, said first roller and said pressure roller cooperating to form a nip, said separated negative film segments engaging said nip after separation and biasing means associated with said pressure roller for baising said pressure roller toward said first roller.

4. In a strip cutter for separating adjacent negative film segments attached to a continuous strip of tabbing material by severing said tabbing material between adjacent negative segments as said continuous strip advances through said strip cutter, said strip cutter having means for selectively removing chips of tabbing material from between adjacent negative segments, said separated film segments exiting said strip cutter in a first direction, means for mechanically segregating said tabbing material chips from said separated film segments including a blade means operable to cut said tabbing material and mounted for rotational movement from a home position in which said blade means allows said separated segments to exit said strip cutter in said first direction through a cutting stroke in which said blade means engages and severs said tabbing material and back to said home position, said blade means further having a deflecting position wherein it engages said tabbing material chip prior to severance and deflects said tabbing material chip away from said first direction and blade actuating means for moving said blade means into and from said home and deflecting positions and through said cutting stroke in timed relation to the advancement of said strip, the improvement comprising ejector means mounted adjacent said blade means for assisting the negative segments in exiting the cutter after separation of the segments, said ejector means including a first roller rotatably mounted above the path of advancement of said strip, said first roller being drivingly coupled to said blade means such that said first roller rotates solely in response to movement of said blade means, a pressure roller rotatably mounted below the path of advancement of said strip, said first roller and said pressure roller cooperating to form a nip, said pressure roller being mounted for movement toward and away from said first roller in response to movement of said blade means from said home position toward said cutting stroke, said ejector means including a cam member rigidly attached to said blade means and a cam follower member rigidly coupled to said pressure roller in cooperable engagement with said cam member, said cam member and said cam follower member cooperating to space said pressure roller from said first roller when said blade means is in said home position and permitting said pressure roller to move toward said first roller as said blade means toward its cutting stroke and biasing means associated with said pressure roller for biasing said pressure roller toward said first roller.

* * * * *

UNITED STATES PATENT AND TRADEMARK OFFICE

CERTIFICATE OF CORRECTION

PATENT NO. : 4,297,930

DATED : November 3, 1981

INVENTOR(S) : Duane Putzke

It is certified that error appears in the above-identified patent and that said Letters Patent are hereby corrected as shown below:

| | | |
|---|---|---|
| Column 1, | line 34: | "imply" is changed to --simply-- |
| | line 59: | "dilivered" is changed to --delivered-- |
| | line 68: | "tim" is changed to --time-- |
| Column 2, | line 52: | "the" , second occurrence, to -- to --. |
| Column 6, | line 64: | "reflected" is changed to --deflected-- |
| Column 7, | line 49: | insert "to" after "on" |
| Column 8, | line 2: | "pinciples" is changed to --principles-- |
| | line 21: | "signal" is changed to --signals-- |
| Column 9, | line 53: | "On" is changed to --ON-- |
| Column 10, | line 58: | "paste" is changed to --past-- |
| Column 12, | line 12: | "baising" is changed to --biasing-- |

Signed and Sealed this

*Sixteenth* Day of *March 1982*

[SEAL]

*Attest:*

GERALD J. MOSSINGHOFF

*Attesting Officer*

*Commissioner of Patents and Trademarks*